US005505244A

United States Patent [19]

Thumann

[11] Patent Number: 5,505,244

[45] Date of Patent: Apr. 9, 1996

[54] RETRACTABLE COVERING FOR A DOOR OPENING

[76] Inventor: Pierce A. Thumann, 5216 Holly, Pasadena, Tex. 77503

[21] Appl. No.: 287,536

[22] Filed: Aug. 8, 1994

[51] Int. Cl.[6] ..... F04F 10/06

[52] U.S. Cl. ..... 160/23.1; 160/290.1

[58] Field of Search ..... 160/23.1, 26, 29, 160/32, 22, 27, 28, 98, 99, 100, 133, 290.1

[56] References Cited

U.S. PATENT DOCUMENTS

| | | | |
|---|---|---|---|
| 1,015,413 | 1/1912 | Wood . | |
| 1,172,800 | 2/1916 | Johnson | 160/28 |
| 1,958,695 | 5/1934 | Claus . | |
| 1,987,488 | 1/1935 | Morelli . | |
| 2,015,993 | 10/1935 | Drake . | |
| 2,352,609 | 7/1944 | Bates | 160/290.1 |
| 3,105,542 | 10/1963 | Lynch | 160/28 |
| 3,842,890 | 10/1974 | Kramer | 160/26 |
| 3,911,990 | 10/1975 | Hoover et al. | 160/100 |
| 4,197,896 | 4/1980 | Reichstadt | 160/26 |
| 4,359,081 | 11/1982 | Brower | 160/28 |
| 4,458,739 | 7/1984 | Murray et al. | 160/23.1 |
| 4,480,676 | 11/1984 | Solomon | 160/290.1 |
| 4,651,797 | 3/1987 | Lange . | |
| 4,757,852 | 7/1988 | Jentof et al. . | |
| 4,821,786 | 4/1989 | Johnston | 160/26 |
| 4,825,921 | 5/1989 | Rigter . | |
| 4,846,241 | 7/1989 | Chomka et al. . | |

*Primary Examiner*—David M. Purol

*Attorney, Agent, or Firm*—Browning, Bushman, Anderson & Brookhart

[57] ABSTRACT

A retractable covering for a door comprising a housing mounted on one side of the door and a latching strip mounted on the opposite side of the door, the housing containing a roll of screen or similar sheeting material that can be pulled out of the housing across the door opening, one side edge of the screen being fixed to a biased roller assembly interiorally of the housing, the other side edge of the screen being affixed to a rigid side member that has a formation that engages with a formation on the latching strip on the opposite side of the door such that when the screen is pulled out of the housing, it can be latched across the entire opposite side edge of the door, the housing comprising a base plate that abuts one side of the door frame and a casing, or cover, that preferably snap-fits to the base plate.

11 Claims, 3 Drawing Sheets

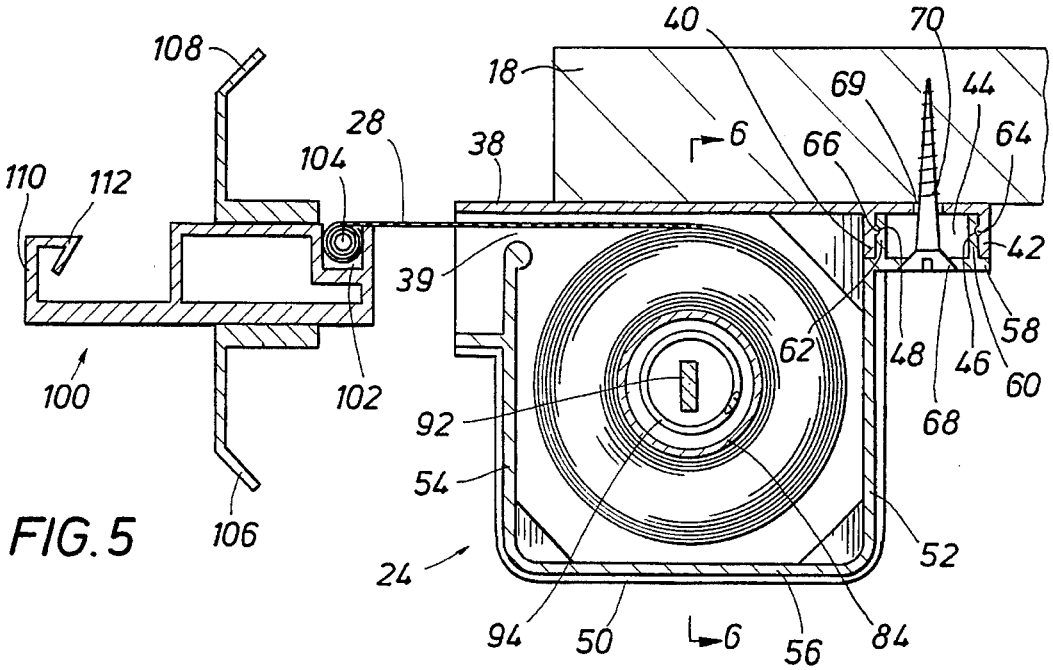
FIG. 5
FIG. 6A
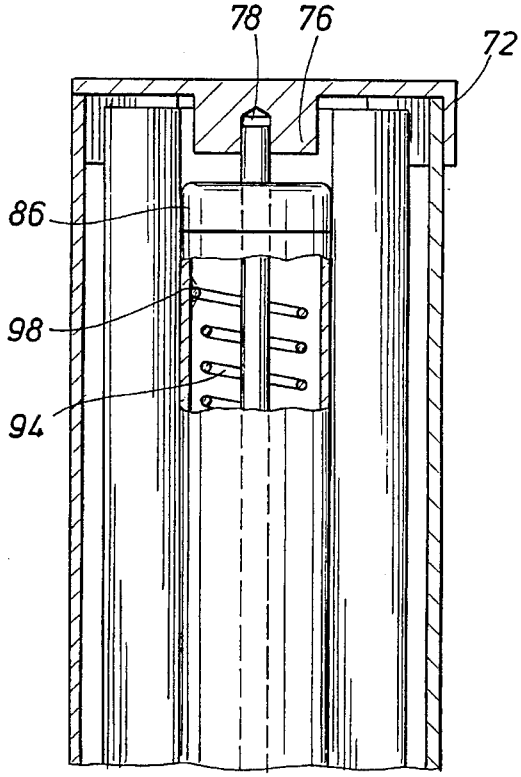
FIG. 6B
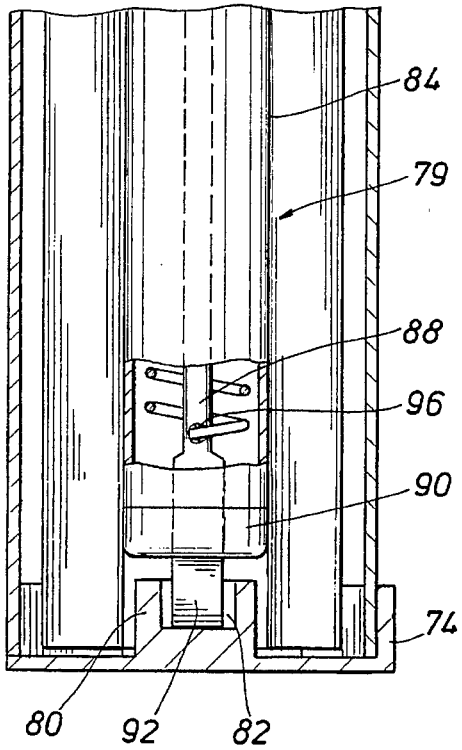

RETRACTABLE COVERING FOR A DOOR OPENING

FIELD OF THE INVENTION

The present invention relates to a retractable covering for a door opening. More particularly, the present invention relates to a retractable covering made of a flexible sheet for selectively covering or overlaying a door opening or the like.

BACKGROUND OF THE INVENTION

Screen doors have been used throughout the years, primarily in residential building, to permit outside air to freely move into a dwelling but prevent ingress of insects into the dwelling. Typically, screen doors, as conventional doors, are of the hinged variety. While screen doors can be used effectively on back door and side door openings of houses, their use in front door openings is frowned upon primarily because they obscure the front door itself from view. In this regard, it is to be noted that an aesthetically pleasing front door is desired since it enhances the first impression of a dwelling. Accordingly, for the most part screen doors are generally not used over front door openings. This is undesirable since there are times during pleasant weather or when it is desired to air out a house to open all of the doors and windows. The normal absence of a screen door over the front door opening, however, generally means that the front door is not opened so as to keep out insects and the like.

Retractable screens or covering assemblies for a door opening are disclosed in U.S. Pat. Nos. 4,651,797; 4,821,786; and 4,825,921.

SUMMARY OF THE INVENTION

It is therefore an object of the present invention to provide an improved retractable covering for a door opening that can be substantially concealed while not covering the door opening.

Another object of the present invention is to provide an improved retractable screen for a door opening.

Yet a further object of the present invention is to provide an improved retractable covering for a door opening that can be selectively placed into and out of covering relationship with the door opening.

The above and other objects of the present invention will become apparent from the drawings, the description given herein, and the appended claims.

The retractable covering assembly for a door opening of the present invention is used with a door opening or the like that is at least partially defined by a first side support, a second side support, a top edge surface, and a bottom edge surface. The assembly comprises an elongate housing that is secured to the first support surface. The elongate housing has an elongate opening, or slot, facing the second side support surface. A flexible sheet, such as a screen, having a size sufficient to substantially cover the door opening, has a first side edge, a second side edge, a top edge, and a bottom edge. The first side edge of the sheet is fixed in the housing, the sheet being movable from a first position wherein the sheet is contained in the housing to a second position wherein the sheet substantially covers the door opening. The retractable covering is further provided with means for retracting the sheet into the housing into the first position. There are also latching means for releasably holding the sheet in the second position when the sheet is moved from the first position—i.e., interiorally of the housing—to the second position.

In one embodiment:, the latching means includes an elongate latching strip secured to the second side support, the latching strip extending substantially the height of the door opening. The second side edge of the flexible sheet is attached to a rigid side member that also extends for substantially the height of the door opening. The latching strip and rigid side member are provided with latching formations projecting as to one and receiving as to the other such that when the latching formations are engaged, and the flexible sheet is moved into the second position, the sheet is maintained in the second position. The receiving and projecting formations on the latching strip and rigid side member, respectively, extend for substantially the length of the latching strip and the rigid side member.

In another embodiment, the housing includes an elongate base plate and an elongate casing or cover. The cover is preferably U-shaped in cross-section, having a first side leg, a second side leg, and a web connecting the first and second side legs. The base plate and the cover are provided with longitudinally extending connecting formations projecting as to one and receiving as to the other, whereby the cover can be fitted, preferably snap-fitted, to the base plate. The elongate slot in the housing is preferably defined between the first leg of the cover and the base plate, the elongate slot facing the second side support.

BRIEF DESCRIPTION OF THE DRAWINGS

FIG. 5 is an enlarged top view, partially in section, showing the housing and flexible sheet forming the retractable covering of the present invention.

FIG. 6A, is a view taken along the lines 6—6 of FIG. 5 showing journalling of the sheet rod in the top of the housing.

FIG. 6B is a view taken along the lines 6—6 of FIG. 5 showing the gudgeon of the sheet rod received in a bottom boss of the housing.

DESCRIPTION OF THE PREFERRED EMBODIMENTS

While the present invention will be described with particular reference to a retractable covering—e.g., a screen for selectively a covering door opening in a house or the like—it is to be understood that the retractable covering of the present invention can be used with any opening in a structure of any type wherein it is desired to eliminate a hinged covering for the door opening. Accordingly, the retractable covering of the present invention can be used in mobile homes, temporary shelters, or the like.

Figure 1:
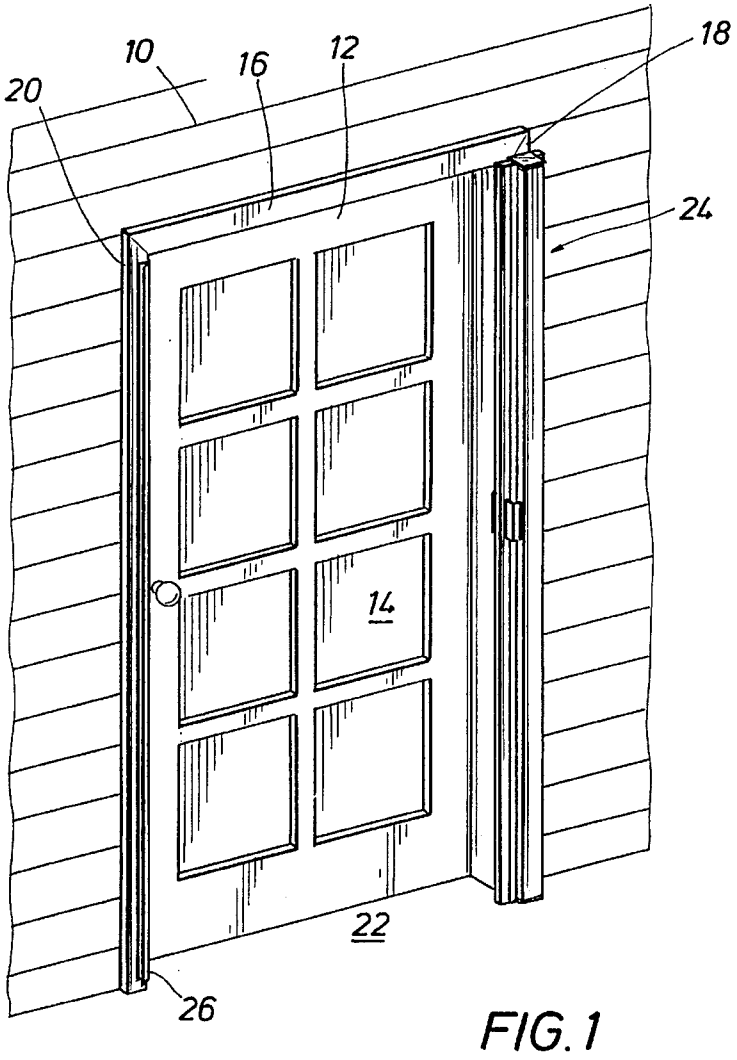
FIG. 1 is a perspective view of a door opening showing the releasable covering in a retracted position.

With reference to FIG. 1, there is shown a partial wall 10 of a house having a door opening 12, the door opening 12 being fitted with a conventional hinged door 14 in a well-known manner. As is customary, the door opening 12 is outlined by a casement comprised of top molding, or trim, piece 16 and first and second side molding, or trim, pieces 18 and 20, respectively. A floor, threshold, or similar surface 22 defines the bottom of the door opening 12. Secured to the first molding 18 is a housing shown generally as 24, housing 24, as described hereinafter, containing or concealing a retractable flexible sheet. Attached to the second or opposite side molding 20 is a latching strip shown generally as 26. FIG. 1 thus demonstrates how the retractable covering of the present invention is substantially in a concealed position; i.e., the door 14 is exposed to view.

Figure 2:
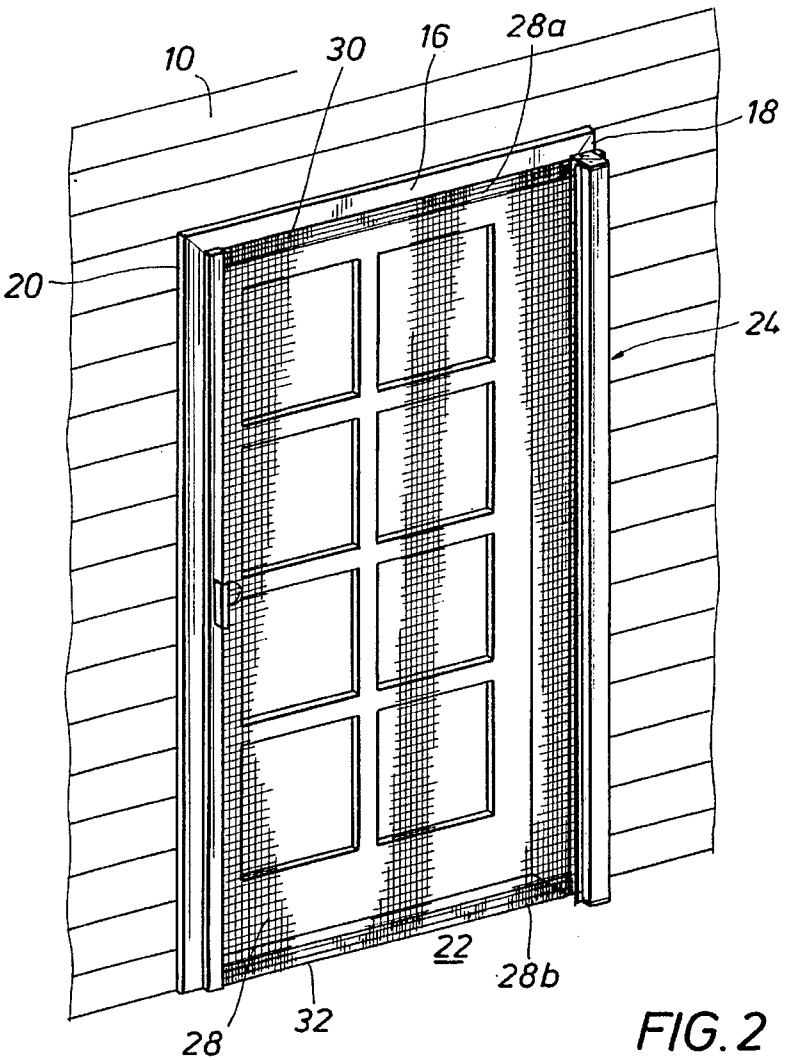
FIG. 2 is a view similar to FIG. 1 showing the retractable covering in a position covering the door opening.
Figure 4:
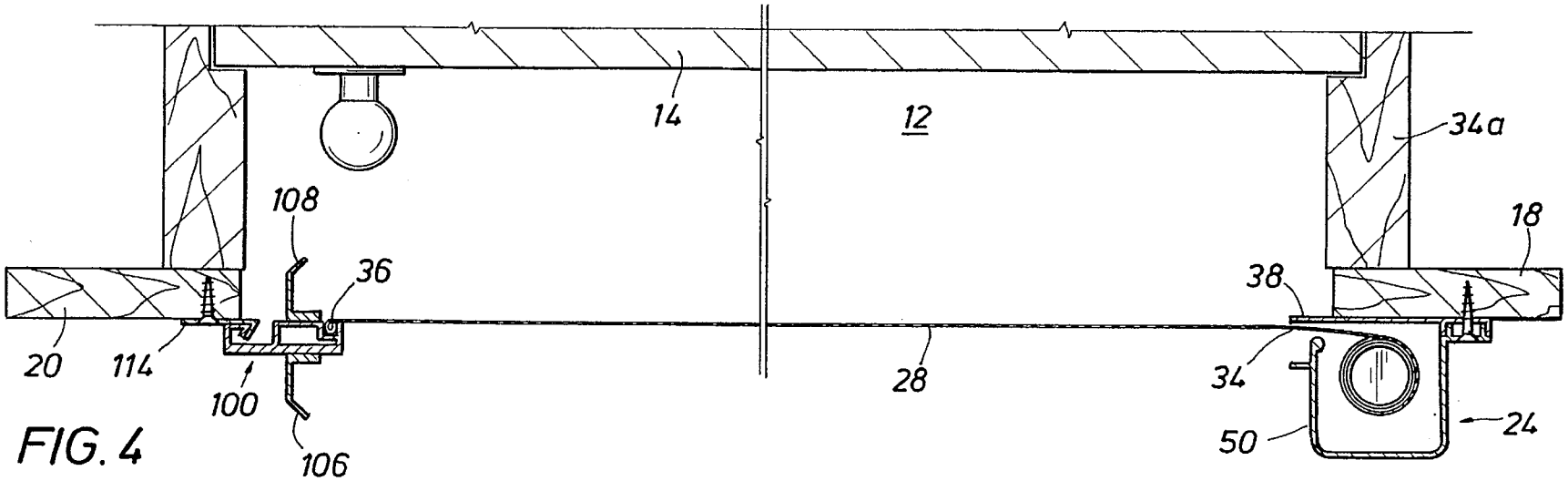
FIG. 4 is a top, cross-sectional view showing the retractable covering in the position shown in FIG. 2.

With reference to FIG. 2, it can be seen that a flexible sheet comprising a screen 28 has been pulled from housing 24 and latched to latching strip 26 such that screen 28 now substantially covers door opening 12. As shown with reference to FIGS. 2 and 4, screen 28 has a top edge 30, a bottom edge 32, a first side edge 34, and a second side edge 36. Screen 28 is provided with upper and lower reinforcing weave borders **28*a* and 28*b* that prevent screen 28 from fraying at its top and bottom edges 30 and 32, respectively. As can be seen in FIG. 2, when screen 28 is retracted out of housing 24 and latched to latching strip 26, door opening 12 is substantially covered since top edge 30 of screen 28 closely fits against molding 16 and bottom edge 32 lies closely adjacent floor or surface 22. As best seen in FIG. 4, screen 28 extends from first side molding piece 18 to second side molding piece 20, thereby effecting a substantial full covering—i.e., height and width—of door opening 12**.

Figure 3:
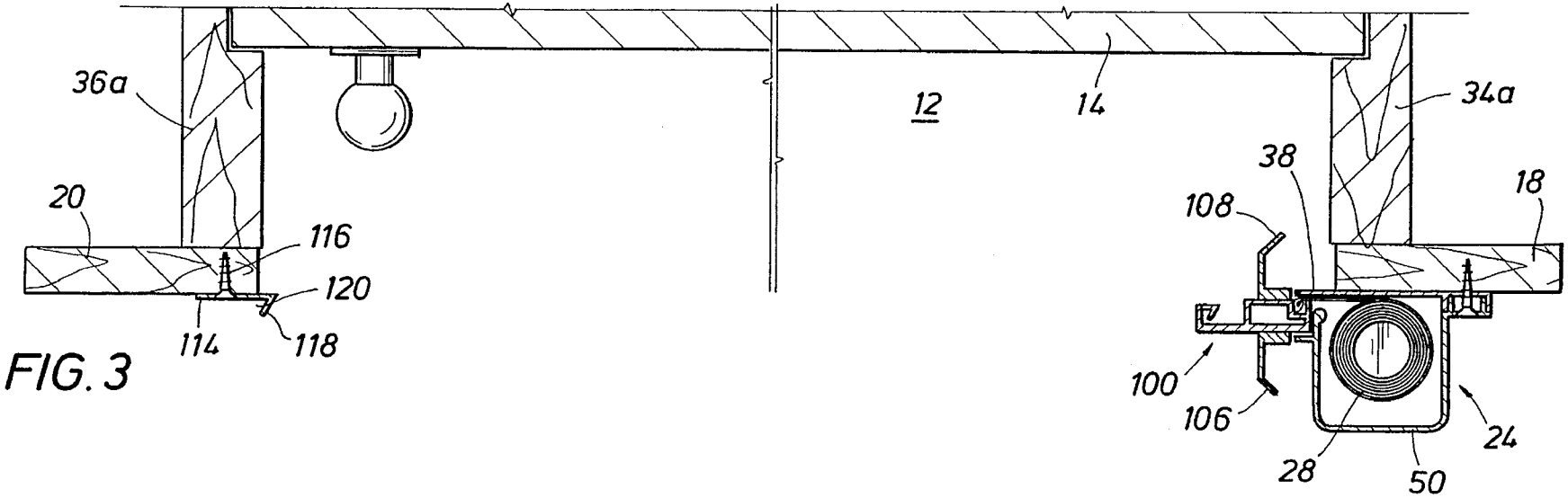
FIG. 3 is a top, cross-sectional view showing the retractable covering in the position shown in FIG. 1.

With reference to FIGS. 3 and 4, it can be seen that door 14 is hingedly (not shown) affixed to doorjamb 34A and accordingly opens away from opposite side doorjamb 34A. In a conventional fashion, molding pieces 18 and 20 are secured to doorjamb members 34A and 36A, respectively. It will be understood that while the door casement assembly comprising doorjambs members 34A and 36A and molding pieces 16, 18, and 20 are made of wood, it will be recognized that the doorjamb assembly forms no part of the invention and accordingly is shown in simplistic fashion to illustrate the invention. More particularly, it will be appreciated that in many residential dwellings the support surfaces that surround and define the door opening 12 and to which the covering assembly of the present invention is attached will be of brick or other construction.

With reference now to FIGS. 3, 4, 5, 6A, and 6B, the construction of the door covering assembly of the present invention is shown in greater detail. Housing 24 is comprised of an elongate base plate 38 having elongate, outwardly extending flanges 40 and 42 running longitudinally along the length of plate 38, flanges 40 and 42 forming an outwardly facing, elongate channel 44. As can be seen, flanges 40 and 42 are provided with longitudinally extending beads 46 and 48, respectively, which face one another interiorally of channel 44. Housing 24 further comprises a generally U-shaped, elongate casing, or cover, 50 having elongate, opposed side walls 52 and 54 and a connecting, elongate web 56 adjoining side walls 52 and 54. Casing 50 is provided with a laterally outwardly projecting, elongate wing portion 58 from which depend spaced, elongate flanges, or legs, 60 and 62, flanges 60 and 62 extending in generally the same direction as side walls 52 and 54. As best seen in FIG. 5, flanges 60 and 62 are provided with longitudinally extending recesses 64 and 66, respectively. The flanges 60 and 62, which run parallel to one another, are spaced from each other by a distance such that flanges 60 and 62 can be received in channel 44 such that recesses 64 and 66 receive beads 60A and 62A in a snap-in fashion. In effect, flanges 40 and 42 on base plate 38 and flanges 60 and 62 on casing 50 both define channels that are in register with one another when the flanges 60 and 62 are received in the channel 44 defined by flanges 40 and 42. Effectively, the flanges 40, 42, and 60, 62 define connecting formations that are projecting as to one and receiving as to the other such that they form a connecting means to permit casing 50 to be connected to base plate 38. In other words, casing 50 simply snaps into base plate 38. When casing 50 is snap-fitted to base plate 38, it will be seen that an elongate slot 39 is formed between leg 54 and base plate 38. To secure housing 24 to the molding 18, laterally outwardly extending wing portion 58 is provided with a series of spaced holes 68 that are in register with a like number of holes 69 in base plate 38 and in which are received screws 70, screws 70 being screwed into in molding 18, as seen in FIG. 5. Thus, housing 24 is securely mounted to side molding, or trim, piece 18.

Housing 24 further comprises upper and lower removable caps, shown in FIGS. 6A and 6B as 72 and 74, respectively, caps 72 and 74 being snap-fitted onto the upper and lower ends, respectively, of casing 50.

Upper cap 72 has a generally centrally disposed trunnion, or boss, 76 provided with a circular bore 78 therein. Lower cap 74 is also provided with a trunnion, or boss, 80 having a rectangular bore 82. A roller assembly, shown generally as 79, comprises an outer rotatable roller red 84 and an inner shaft 88. Outer roller 84 is provided with a top end cap 86 through which extends the upper end of inner shaft 88, the upper end of shaft 88 being received in bore 78 of trunnion 76. Outer roller rod 84 is also provided with a lower cap 90 through which extends the opposite end of shaft 88, which, as can be seen, is supplied with flats forming a generally rectangular end 92 such that when the end 92 of shaft 88 is received in rectangular bore 82, shaft 88 is prevented from rotating.

Disposed internally of roller rod 84 and in surrounding relationship to shaft 88 is a spiral, or coil, spring 94. Spiral spring 94 has one end 96 fixed to inner shaft 88 (see FIG. 6B) and the opposite end 98 fixed to outer roller 84 (see FIG. 6A). It will thus be appreciated by those skilled in the art that outer roller 84 can rotate relative to inner shaft 88 and that when outer roller 84 is rotated in a direction to wind spring 94, a biasing force is placed on outer roller 84, the biasing force tending to return roller 84 to the position wherein spring 94 is unwound.

The first edge of screen 34 is affixed to outer roller 84—e.g., by gluing, stapling, or in any other well-known manner not shown—and screen 28 is wound around roller 84 when spring 94 is in the unwound condition. Accordingly, screen 28, as best shown in FIG. 5, will be wound in a series of concentric layers around roller rod 84 and be concealed in housing 24.

The second, or opposite, edge 36 of screen 28 is secured to an elongate, rigid side member 100 that extends substantially along the length of the second side edge of screen 28. To this end, side member 100 is provided with a longitudinally extending groove 102. The second side edge 36 of screen 28 is wound around a spline 104 a sufficient number of times such that windings of screen 28 around spline 104 form a bundle that is snugly received in channel 102, thereby securing screen 28 to rigid side member 100. Rigid side member 100 is provided with a first handle 106 that projects or extends away from the front side of screen 28 and a second handle member 108 that extends from the back side of screen 28, the reference as to front and back being as one would face the door opening from the front of a house. It will be appreciated that handles 106 and 108 can be secured to rigid side member 100 in any conventional manner such as with screws, bolts, or the like.

Rigid side member 100 is further provided with a longitudinally extending flange 110 that extends generally the full length of side member 100 and from which depends a longitudinally extending, generally V-shaped projection 112 that extends for the length of flange 110. With reference now to FIG. 3, elongate latching strip 26 has an elongate base plate 114 that is secured, as shown, by screws 116 to molding, or trim, piece 20. An elongate angled flange 118 depends from one edge of latching strip 114, flange 118 together with latching strip 114 serving to define a generally V-shaped channel 120. With reference now to FIG. 4, it can be seen that by grasping either handle 106 or 108, screen 28 can be pulled out of housing 24 through slot 39 toward latching strip 26. As noted above, as screen 28 is unwound from roller assembly 79, spring 94 is wound and exerts a biasing force of roller 84 in a direction away from the direction in which screen 28 is being pulled as it is moved toward latching strip 26. At such point as screen 28 and, more particularly, rigid side member 100 have been pulled across the width of door opening 12, V-shaped formation 112 formed on rigid side member 100 can be engaged in V-shaped channel 120 on latching strip 26 in a dovetail manner, thereby effectively latching screen 28 in a position such that it substantially covers door opening 12, both in height and width. Because spring 94 has been wound, there is a constant bias on screen 28 urging it back towards housing 24 thereby holding it taut across door opening 12 and giving a neat appearance. Additionally, since V-shaped projection 112 and V-shaped groove 120 extend for substantially the full length of rigid member 100 and latching member 26, respectively, there is an effective seal along both sides of the door opening 12—i.e., the screen fits snugly across the door opening 12. Because screen 28 can be easily sized, as to height, to extend the full height of door opening 12, screen 28 will thus substantially cover door opening 12.

It will be appreciated that while the invention has been described with respect to the use of a conventional screen, preferably a flexible screen such as screen made of fiberglass or the like, plastic sheeting such as transparent plastic sheeting can be substituted for screening if desired. The components of the housing 24, the rigid side member 100, and the latching strip 26 can be easily constructed from extruded aluminum or can be made from certain plastics such as engineering plastics. The snap-in feature of cover 50 with respect to base plate 38 makes installation and assembly of the door covering of the present invention simple and quick.

In effect, elongate projection 112 and elongate channel 120 define latching formations that are projecting as to one and receiving as to the other such that when they are engaged, rigid side member 100 is engaged along its entire length with latching strip 26 along its entire length. It will be appreciated that other engageable formations that extend along the length of latching strip 26 and rigid side member 100 can be employed.

While there has been shown and described above a certain specific structure embodying this invention, it will be manifest to those skilled in the art that various modifications and rearrangements of the parts may be made without departing form the spirit and scope of the underlying inventive concept and that the same is not limited to the particular forms herein shown and described except insofar as indicated by the scope of the appended claims.

What is claimed is:

1. A retractable covering for a door opening, said door opening a height and a width and being at least partially defined by a first side support, a second side support, a top edge surface, and a bottom edge surface, comprising:

an elongate housing secured to said first support, said elongate housing including an elongate base plate for abutting said first side support and an elongate, generally U-shaped cover, said base plate and said cover being provided with longitudinally extending connecting formations projecting as to one and receiving as to the other whereby said cover can be fitted to said base plate, said housing including an elongate slot facing said second side support;

means for securing said base plate and said cover to one another and to said first side support;

a flexible sheet having a size sufficient to substantially cover said door opening, said flexible sheet having a first side edge, a second side edge, a top edge, and a bottom edge, said first side edge being fixed in said housing, said sheet being movable from a first position, wherein said sheet is contained in said housing to a second position wherein said sheet substantially covers said door opening;

means for retracting said sheet into said housing into said first position; and latching means for releasably holding said sheet in said second position when said sheet is moved from said first position to said second position.

2. The retractable covering of claim 1, wherein said means for retracting said sheet into said housing comprises biasing means for urging said sheet into said housing.

3. The retractable covering of claim 1, further including a roller assembly mounted in said housing, said roller assembly comprising an outer, rotatable roller rod and an inner shaft, said inner shaft being fixed against rotation relative to said roller rod, said roller assembly further including a spiral spring having a first end attached to said inner shaft and a second end attached to said outer roller rod whereby rotation of said outer roller rod in one direction winds said spring, said first edge of said sheet being secured to said roller rod.

4. The retractable covering of claim 1, wherein said sheet comprises a screen material.

5. The retractable covering of claim 1, wherein said flexible sheet comprises a thin, flexible plastic material.

6. The retractable covering of claim 5, wherein said plastic material is substantially clear.

7. The retractable covering of claim 1, wherein said latching means includes a latching strip secured to said second side support and extending for substantially the height of said door opening, said latching means further including an elongate, rigid side member attached to and extending along the length of said second side edge of said sheet, said rigid side member and said latching strip being provided with longitudinally extending latching formations projecting as to one and receiving as to the other, said latching formations extending for substantially the full length of said latching strip and said rigid side member, respectively, whereby when latching formations are engaged, said sheet is held in said second position.

8. The retractable covering of claim 5, wherein said sheet has a front side and a back side, and there are first handle means extending from said rigid member away from said front side and second handle means extending from said rigid member away from said back side.

9. The retractable covering of claim 1, wherein said connecting formations projecting as to one and receiving as to the other include means to snap-fit said cover to said base plate.

10. The retractable covering of claim 1, wherein said cover has first and second side legs and a web connecting said first and second side legs.

11. The retractable covering of claim 10, wherein said elongate slot is defined by said first leg and said base plate.

* * * * *